US006487942B1

(12) United States Patent
Carter et al.

(10) Patent No.: US 6,487,942 B1
(45) Date of Patent: Dec. 3, 2002

(54) FIRE SPRINKLER HEAD TOOL

(75) Inventors: Tom Carter, 234 Shoreline Hwy., Mill Valley, CA (US) 94941; Michael P. Burkell, Mill Valley, CA (US)

(73) Assignee: Tom Carter, Mill Valley, CA (US)

( * ) Notice: Subject to any disclaimer, the term of this patent is extended or adjusted under 35 U.S.C. 154(b) by 0 days.

(21) Appl. No.: 09/650,333

(22) Filed: Aug. 28, 2000

Related U.S. Application Data

(60) Provisional application No. 60/151,152, filed on Aug. 27, 1999.

(51) Int. Cl.[7] ..... B25B 7/02

(52) U.S. Cl. ..... 81/426.5; 81/420; 81/367

(58) Field of Search ..... 81/419, 420, 424.5, 81/426.5, 367–383, 421–424, 427.5

(56) References Cited

U.S. PATENT DOCUMENTS 1,910,750 A * 5/1933 Clark ..... 81/426.5
2,277,542 A * 3/1942 Curlee ..... 81/426.5 X
2,381,703 A * 8/1945 Stinson ..... 81/415 X
2,602,357 A * 7/1952 Nash ..... 81/426.5
5,193,336 A * 3/1993 King ..... 81/426.5 X
5,305,669 A * 4/1994 Kimbro et al. ..... 81/426.5 X
5,611,519 A * 3/1997 Garcia ..... 81/426.5
5,630,345 A * 5/1997 Ciccotelli ..... 81/373

* cited by examiner

*Primary Examiner*—D. S. Meislin
(74) *Attorney, Agent, or Firm*—Larry D. Johnson; Craig M. Stainbrook; Johnson & Stainbrook, LLP

(57) ABSTRACT

A fire head sprinkler tool comprising a pair of jaw extensions which may be either integral with or removably connected to a large capacity clamping or locking pliers. The locking pliers have a movable and a fixed jaw, and the jaws define a large cylindrical inner opening. The jaw extensions include upper working portions which further include concave gripping portions. The jaw extensions extend substantially laterally from one side of the jaw portion of the pliers, and the vertical axes of the jaw extensions are offset from the plane of the jaw side at an angle.

9 Claims, 5 Drawing Sheets

FIRE SPRINKLER HEAD TOOL

CROSS REFERENCE TO RELATED APPLICATIONS

The present application claims the benefit of the filing date of U.S. Provisional Patent Application, Ser. No. 60/151,152, filed Aug. 27, 1999.

BACKGROUND OF THE INVENTION

1. Field of the Invention

The present invention relates generally to hand held tools and, more particularly, to a tool adapted for fire sprinkler head removal and installation without the need for ceiling tear out.

2. Discussion of Related Art

The failure of a ceiling mounted fire sprinkler head, whether through product failure or through accidental damage, necessitates the removal of the sprinkler head from the system and the installation of an undamaged replacement part. In recent years there has been a recall of some models of sprinkler heads due to product failures and potential product failures. Because the replacement of defective or damaged sprinkler heads requires some tear out of the ceiling in which the sprinklers are installed, the systematic replacement of defective sprinkler heads has resulted in large-scale repair of ceiling and other building structures.

Were it possible to remove and replace the sprinkler heads without ceiling tear out, the inconvenience and costs of repairing the tear out and restoring the ceiling to its desired appearance could be avoided. Even so, to date there has been no known universal tool that could achieve this objective. Accordingly, with an understandable self-interest, at least one sprinkler head manufacturer has provided a product-specific device adapted for use with only its own sprinkler heads. However, the use of this device to remove proprietary sprinkler heads requires two workmen, and when tradesmen have been called upon to replace other brands, the workers have clumsily adapted tools intended for other purposes and have not been able to accomplish the task without the above-described problems. This often results in more damage than intended, including damage to sprinkler head adapters, which frequently crack or suffer thread damage.

There is, in consequence, a need for a tool to facilitate the removal of existing fire sprinkler heads and the installation of replacement heads without the need for ceiling tear out and with minimum risk of damage to the sprinkler head adapter and other piping structures.

SUMMARY OF THE INVENTION

The fire sprinkler head tool of the present invention solves the foregoing problems by providing a pair of jaw extensions which may be either integral with or removably connected to a large capacity clamping or locking pliers. The locking pliers have a movable and a fixed jaw, and the jaws define a large cylindrical inner opening of sufficient in diameter to accommodate a standard plumber's 1¼ inch (3.18 cm) wrench socket, as is customarily required to remove a sprinkler head. The jaw opening may be larger or smaller without affecting the fundamental operating characteristics of the tool. The jaw extensions include upper working portions which further include concave gripping portions. The gripping portions preferably have teeth to grip a sprinkler head adapter during use. In a first preferred embodiment, the inventive fire head sprinkler tool further comprises a stop block integral with the fixed jaw of the pliers, which cooperates with a threaded adjuster block affixed to the movable jaw and an adjuster screw threadably inserted through the adjuster block. These structures allow the user to define a stop point for closure of the jaws, and therefore minimum opening size of the jaws, smaller than which the user cannot go that prevents the user from damaging the adapter and from obstructing the insertion and turning movements of the socket. The vertical axes of the jaw extensions are offset from the plane of the jaw side at an angle between 90 and 180 degrees.

In a second preferred embodiment of the present invention, jaw extensions are independent from any device used to secure the jaws over the sprinkler head adapter and are pivotally connected to one another to facilitate use with clamping pliers.

DETAILED DESCRIPTION OF A PREFERRED EMBODIMENT

Figure 1:
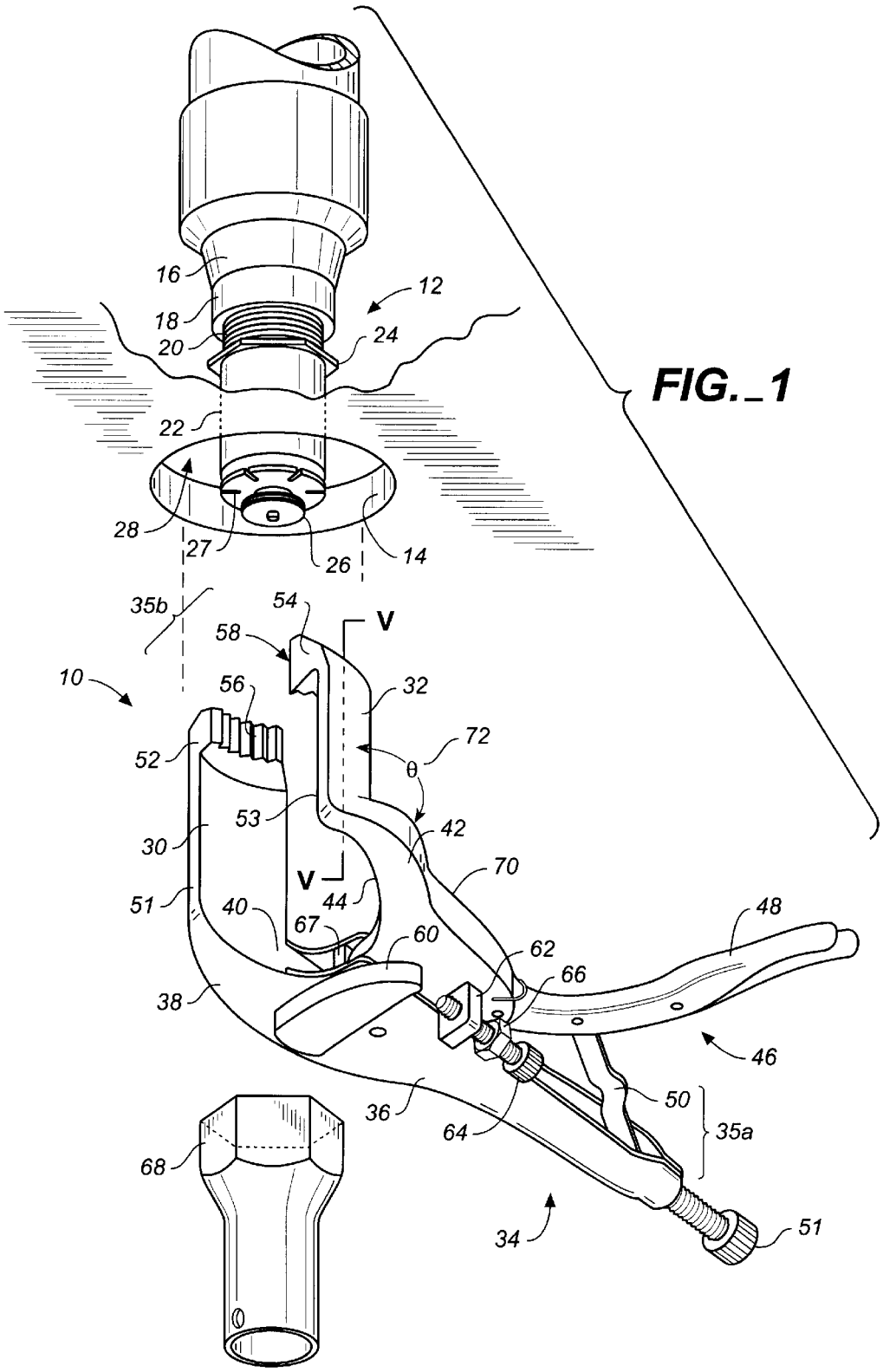
FIG. 1 is a perspective view a first preferred embodiment of the fire sprinkler head tool of the present invention, showing the tool in the environment of its use.

FIG. 1 is a perspective view a first preferred embodiment of the fire sprinkler head tool of the present invention, generally denominated 10 herein. This view shows the tool in the environment of its use; and, more specifically, positioned immediately underneath a conventional fire sprinkler head 12 mounted into and above a finished ceiling 14.

Referring now to FIG. 1, it is well known that the conventional fire sprinkler head is generally connected to a sprinkler system via a threaded adapter 16, frequently fabricated from chlorinated polyvinyl chloride (CPVC), though occasionally copper or cast iron, said adapter having a lower neck 18. The diameter of the adapter bore is generally substantially constant. The sprinkler head generally has a male end comprising an integral threaded metal insert 20 (ordinarily brass), which screws into the adapter bore, and a cylindrical body portion 22 having outer circumferential flats 24 at its upper end for allowing the fitting to be grasped and held by a tool such as an adjuster spanner or socket wrench. The body portion, male end, and flats generally constitute an integral unit, and the flats generally comprise a hex nut. At its lower end the sprinkler head includes a nozzle portion 26 having a deflector 27 for broadcasting water in a wide and effective pattern into the building space.

The head may extend slightly below the ceiling surface in some settings, particularly in older buildings where fire safety retrofitting has been conducted, or in more industrial settings. In residential or upscale office spaces, by contrast, where fire safety is balanced with aesthetics, the fire sprinkler head is generally flush mounted in the ceiling so that only its nozzle portion is exposed. Moreover, the sprinkler head is typically set into an escutcheon (not shown) that provides a finished appearance. When the escutcheon is removed, as shown, an opening 28 is defined such that the circumferential flats 24 of the fitting 22 are exposed, but a wrench inserted into the opening effectively blocks access to the adapter immediately above the fitting. As a result, it is extremely difficult to hold back the adapter 16 when a turning force is applied to the fitting 24. This can result in cracking of the adapter or damage to the pipe.

To solve this problem, a fire sprinkler head tool 10 is provided, said tool comprising a first and a second jaw extension, 30, 32, which may be either integral with or removably connected to a large capacity clamping or locking pliers 34. As is well known in the art, pliers generally comprise a handle portion 35*a* and a jaws portion 35*b*. As is also well known in the art, large capacity locking pliers, or vise grip pliers, generally comprise a body 36 secured to a fixed jaw 38 defining a first inner concave portion 40, and a movable jaw 42 defining a second inner concave portion 44. The movement and position of the movable jaw with respect to the fixed jaw is controlled by an over-center toggle linkage 46 that pivots the movable jaw relative to the body and locks the movable jaw in position, as is well known in the art. The linkage includes a lever 48 adapted for gripping, a stub arm 50, and an adjustment bolt 51, threadably coupled to the body to bias the stub arm and adjust the toggle linkage. An example of such pliers is disclosed in U.S. Pat. No. 5,351,585 to Leseberg et al, incorporated in its entirety by reference herein.

First and second jaw extensions, 30, 32, extend substantially laterally from the same generally planar side 70 of the jaw portion of the pliers, each of said jaw extensions including an upper working portion, 52, 54, respectively, which further include a first and second concave gripping portion, 56, 58. The gripping portions preferably have surface features, preferably teeth or knobby or pointed protuberances, to enhance and facilitate gripping of the sprinkler head adapter during use. The first preferred embodiment of the fire head sprinkler tool further comprises a stop block 60 integral with the fixed jaw the pliers. The stop block cooperates with a threaded adjuster block 62 affixed to the movable jaw, and adjuster screw 64 threadably inserted through said adjuster block, to prevent so much closure of the jaws that movement of an inserted socket is either prevented or its turning obstructed. The adjuster block may include a locking nut 66 to prevent inadvertent readjustment during use. The tool may further include a stabilizer clip, or flat bar bridge 67 welded or otherwise fixedly inserted between the two sides of the body to provide increased strength and to prevent separation of the two sides relative to one another, again reducing flexion of the jaw extensions toward one another near the jaws. This is shown in more detail in FIG. 5.

In the present invention, the openings defined by both the first and second inner concave portions and the first and second concave gripping portions are preferably cylindrical in shape and sufficient in diameter to accommodate at least a 1¼ inch (3.18) socket 68 to insert through the openings defined therein. Finally, the vertical axes V of the jaw extensions are offset from the plane of the jaw side 70 at an angle 72 of between 90 and 180 degrees, though angles of between 15 degrees and 45 degrees are the most practicable and biomechanically advantageous. In order to offset any flex in the jaw extensions induced by clamping down on a sprinkler head adapted, the jaw extensions may be angled inwardly toward one another from their lower portions 51,53, to their upper working portions.

It should be noted that there is nothing imperative in combining the jaw extensions with clamping pliers. Non-clamping conventional pliers, while not providing the gripping force of clamping pliers, could be adapted for use as a fire sprinkler head tool with modifications comparable to those set forth above. Moreover, to accomplish the same objectives, the inventive extended jaws may be integrated with a standard adjustable wrench, or even more preferably a combination standard adjustable wrench and standard vise grip pliers, such as the adjustable pliers wrench hand tool disclosed in U.S. Pat. No. 5,535,650 to McNatt.

Figure 2:
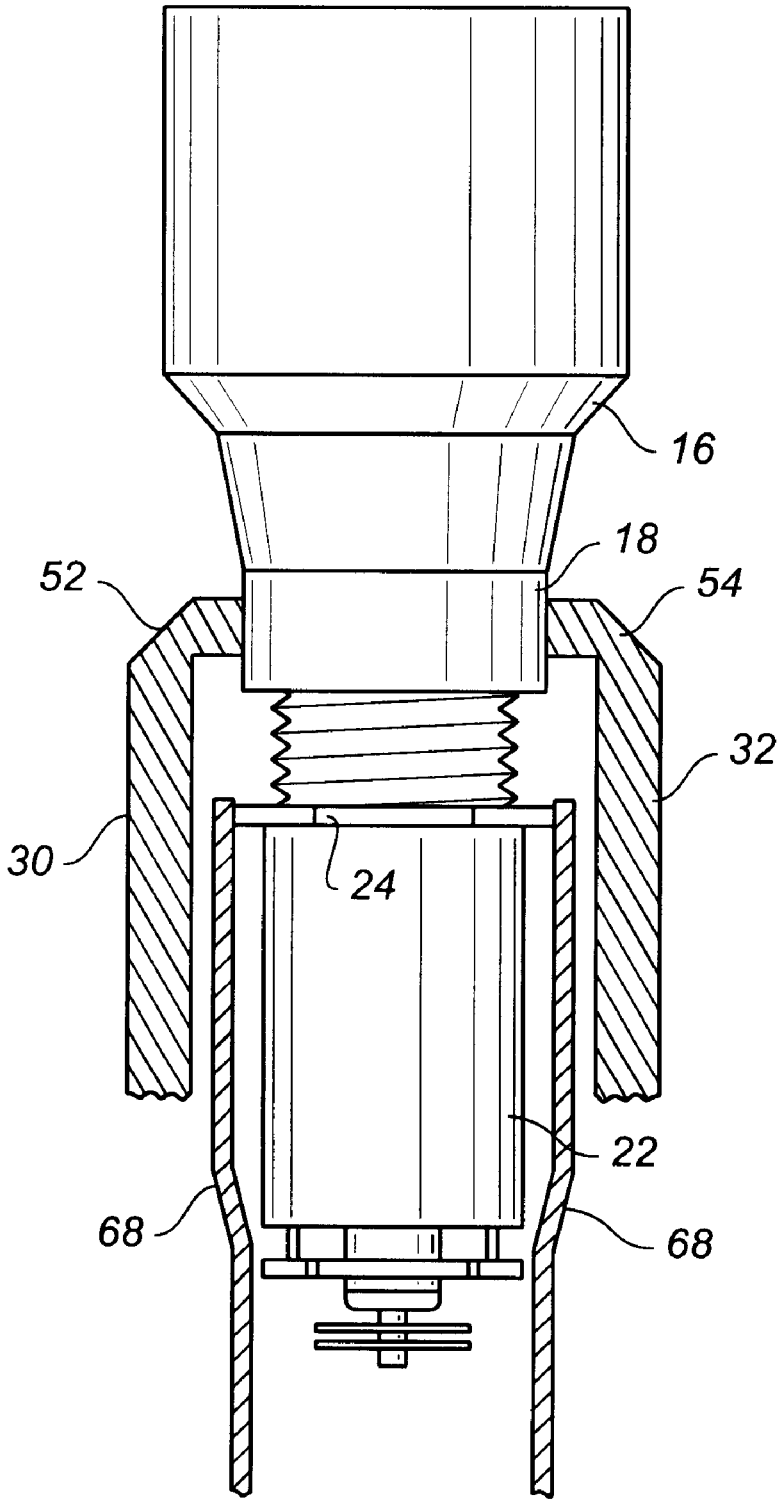
FIG. 2 is a side elevation cross-sectional view of the jaw portion of the first and second embodiments of the present invention.

Referring now to FIGS. 1 and 2, when a sprinkler head is to be removed or installed, the upper portions 52, 54 of the jaw extensions 30, 32 are inserted through escutcheon opening 28 and the concave gripping portions are placed around the lower circumferential neck 18 of the sprinkler head adapter. Then, according to adjustments made by the user to the toggle linkage 46 of the pliers 34, the tool is securely clamped on the adapter, though governed by adjustment to adjuster screw 64 and the consequent limited range of movement of the lower jaw by virtue of the 20 impediment represented by stop block 60.

After the pliers are secured on to the adapter, a socket can be inserted between the concave inner portions 40, 44 of jaws 38, 42, and placed over the circumferential flats, or hex nut, 24 of fitting 22. In this manner, the adapter can be held back as the fitting is turned out from or screwed into the adapter.

Figure 3:
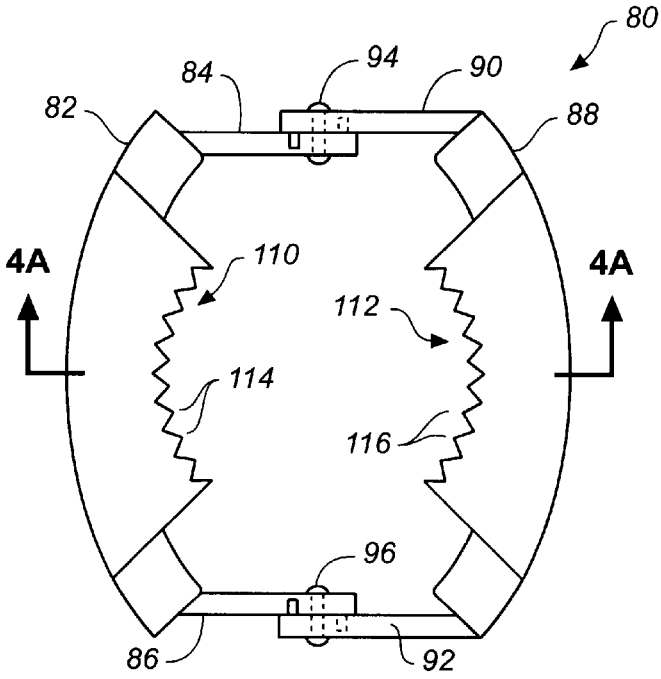
FIG. 3 is a top plan view of a second preferred embodiment of the fire sprinkler head tool of the present invention.
Figure 4A:
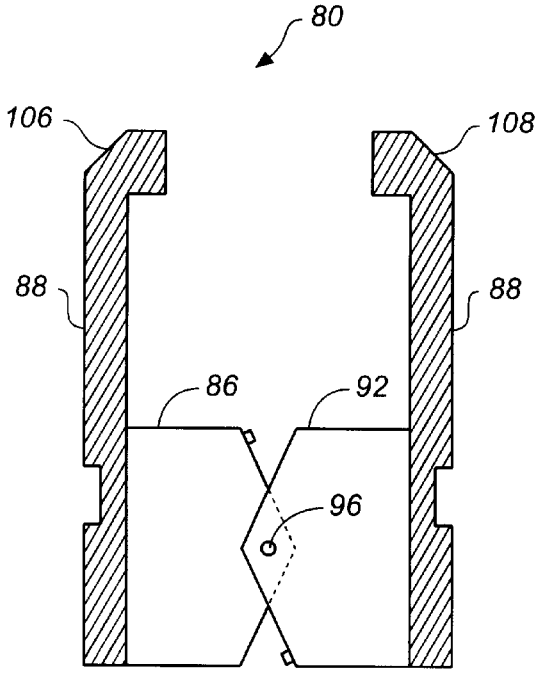
FIG. 4A is a side elevation cross-sectional view of the tool of FIG. 3, showing the jaw members in a closed configuration.
Figure 4B:
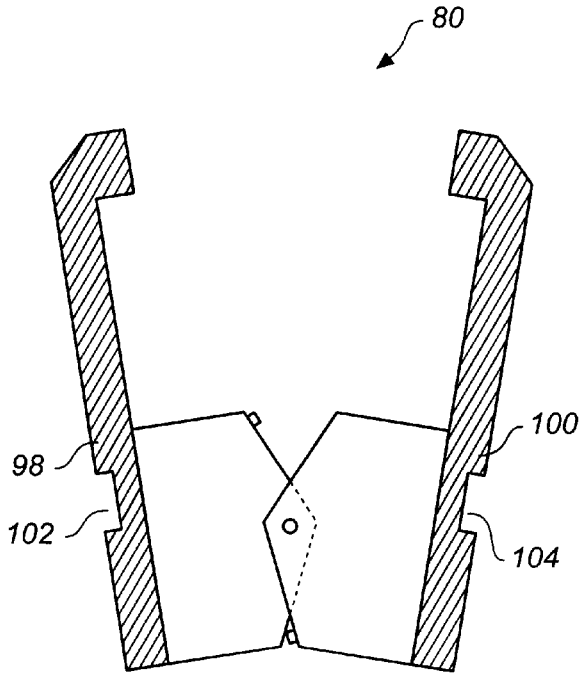
FIG. 4B is a side elevation view cross-sectional of the tool of FIG. 3, showing the jaw members in an open configuration.

FIG. 3 is a top plan view of a second preferred embodiment 80 of the fire sprinkler head tool of the present invention, and FIGS. 4A and 4B are side elevation cross-sectional views thereof, the former showing the jaw members in a closed configuration, and the latter showing the jaw members in an open configuration. In this embodiment, the tool is independent from any device used to secure the jaws over the sprinkler head adapter, such as the locking pliers of the first preferred embodiment. Accordingly, in the second preferred embodiment, the first jaw extension 82 has a first and second tab member 84 and 86, and the second jaw extension 88 has a third and fourth tab member 90 and 92, said first tab member pivotally connected to said third tab member via a first pivot pin 94, and said second tab member pivotally connected to said fourth tab member, each by a second pivot pin, 96. The outer lower portions 98 and 100 of the respective jaw extensions may include a slot or channel 102 and 104 to accommodate the jaws of a clamping pliers. The slots may be slanted to provide the same mechanical and biomechanical advantages of the first preferred embodiment having integral jaw extensions.

As in the first preferred embodiment described supra, the jaw extensions of the second preferred embodiment each include an upper working portion, 106, 108, respectively, which further include a first and second concave gripping portion, 110, 112. The gripping portions preferably have an arcuate row of teeth 114, 116, to grip the sprinkler head adapter during use.

The jaw extensions of the second preferred embodiment may be selectively opened or closed to fit, in the first instance, through the escutcheon hole, and in the second over the sprinkler head adapter neck.

Figure 5:
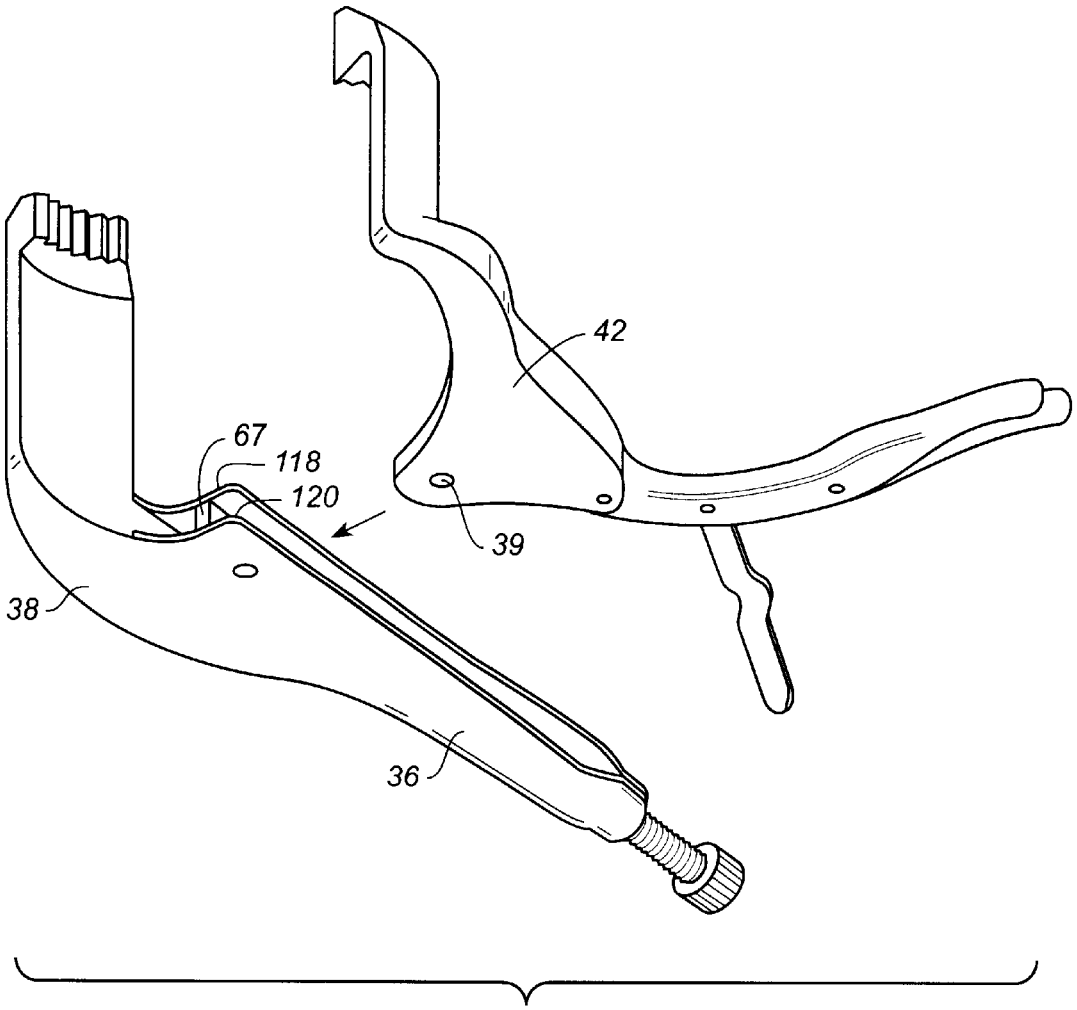
FIG. 5 is a perspective view showing detail of the fixed and movable jaw members separated from one another and an optional stabilizer clip fixedly inserted into the body of the pliers.

FIG. 5 illustrates the body 36 and fixed jaw 38 separated from the movable jaw, and the pivot point 39 at which the jaw members are pivotally connected to one another. This view shows that the body has a first side 118 and second side 120, spaced apart, and an optional stabilizer clip 67 welded or otherwise fixedly inserted between the sides to prevent the sides from separating during use.

Figure 6A:
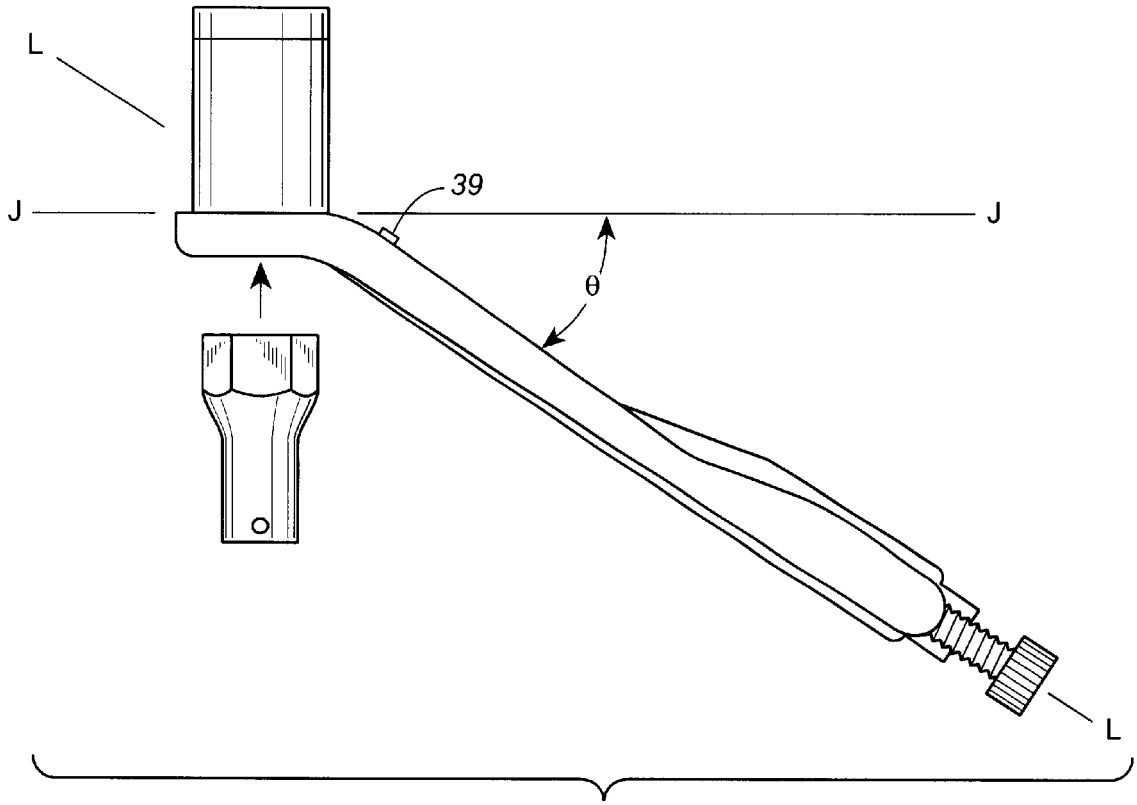
FIG. 6A shows the fire sprinkler head tool of the present invention wherein the angle between the longitudinal axis of the pliers handle and the jaws is defined by a bend in the jaw portion of the pliers.
Figure 6B:
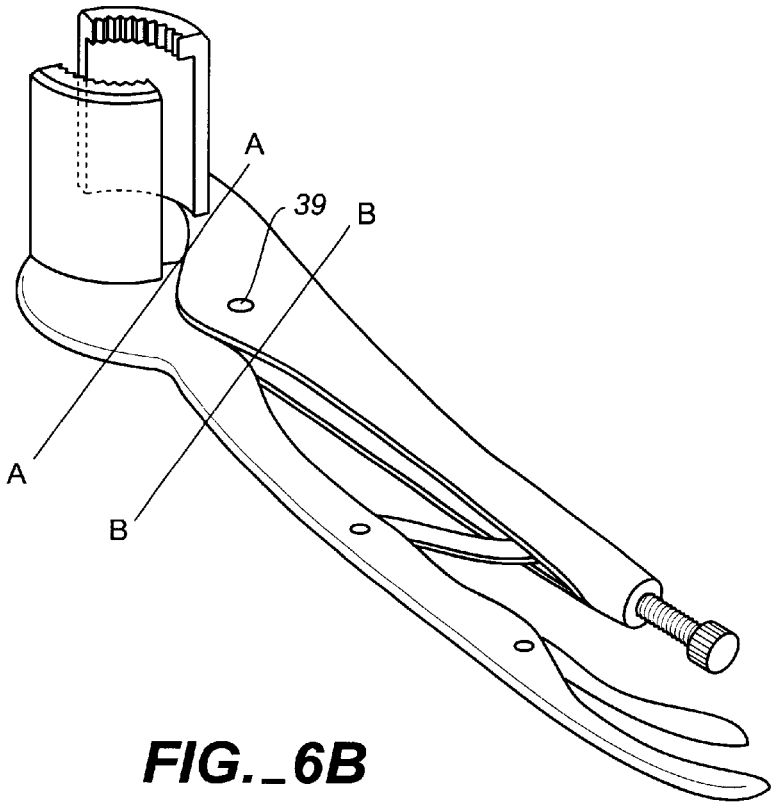
FIG. 6B shows alternative location for defining the angle between the handle and jaw portions of the pliers.

FIG. 6A shows that the angle θ between the plane of the jaws P, and the longitudinal axis of the pliers body L may be defined by a bend in the jaws themselves, distal to the pivot point 39. As noted above, this angle is preferably between 15 and 45 degrees. However, as show in FIG. 6B, the bend may be made either along a line such as A—A proximate the jaw members relative to pivot point 39, as in FIG. 6A, or along a line such as B—B, wherein the pivot point is intermediate the bend line and the jaws.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed is:

1. A fire sprinkler head tool comprising:

a pair of large capacity locking pliers, said pliers having a handle portion and a jaw portion, said jaw portion including a fixed jaw defining a first inner concave portion and a movable jaw defining a second inner concave portion, said handle portion including a body secured to said fixed jaw, and wherein said movable jaw is pivotally connected to said body at a pivot point, wherein the movement and position of the movable jaw with respect to the fixed jaw is controlled by an over-center toggle linkage that pivots the movable jaw relative to the body and locks the movable jaw in position, and wherein said toggle linkage includes a lever adapted for gripping by a user, a stub arm, and an adjustment bolt threadably coupled to the pliers body to bias the stub arm and adjust the toggle linkage;

a first and a second jaw extension connected to the same side of said jaw portion and extending substantially laterally from said side of said jaw portion of said pliers, each of said jaw extensions having an upper working portion and concave gripping portion;

a stop block integral with said fixed jaw of said pliers;

a threaded adjuster block affixed to said movable jaw; and an adjuster screw threadably inserted through said adjuster block, said adjuster screw selectively threadable into and through said adjuster block to alter its proximity to said stop block, wherein said stop block, said threader adjuster block, and said adjuster screw cooperate to restrict the closure of said fixed jaw and said movable jaw during use.

2. The fire sprinkler head tool of claim 1 further comprising a locking nut interposed between said threaded adjuster block and said adjuster screw.

3. The fire sprinkler head tool of claim 1, wherein said first and second inner concave portions and said concave gripping portions each define openings which are cylindrical in shape.

4. The fire sprinkler head tool of claim 3 herein said openings defined by said first and second inner concave portions are at least 1¼ inch (3.18 cm) in diameter.

5. The fire sprinkler head tool of claim 1 wherein said movable jaw and said fixed jaw define a jaw plane and said body of said handle portion has a longitudinal axis, and wherein said tool is bent at a bend line such that said jaw plane is offset from said longitudinal axis at an offset angle.

6. The fire sprinkler head tool of claim 5 wherein said offset angle is between 15 and 45 degrees.

7. The fire sprinkler head tool of claim 5, wherein said bend line is proximate said jaws relative to said pivot point.

8. The fire sprinkler head tool of claim 5, wherein said pivot point is intermediate said bend line and said jaws.

9. The fire sprinkler head tool of claim 1, wherein each of said first and second jaw extensions include a lower working portion, and wherein said jaw extensions are angled inwardly toward one another from said lower portions to said upper working portions.

* * * * *